US008584891B2

(12) United States Patent
Hutchinson et al.

(10) Patent No.: US 8,584,891 B2
(45) Date of Patent: Nov. 19, 2013

(54) MULTI-USE MODULAR CONTAINER

(76) Inventors: Beresford Hutchinson, Newburgh, NY (US); Tanisha Burger-Hutchinson, Newburgh, NY (US)

( * ) Notice: Subject to any disclaimer, the term of this patent is extended or adjusted under 35 U.S.C. 154(b) by 0 days.

(21) Appl. No.: 13/412,689

(22) Filed: Mar. 6, 2012

(65) Prior Publication Data

US 2013/0233865 A1 Sep. 12, 2013

(51) Int. Cl.
*B65D 81/38* (2006.01)
*F25D 3/08* (2006.01)

(52) U.S. Cl.
USPC ..... 220/592.2; 220/915.2; 62/457.7

(58) Field of Classification Search
USPC ..... 220/915.2, 915.1, 592.2, 556, 555, 553, 220/23.86, 23.83, 507; 190/111, 109; 62/457.7, 457.4, 457.3, 457.1; 206/545, 541, 549
IPC ..... B65D 81/38; F25D 3/08
See application file for complete search history.

(56) References Cited

U.S. PATENT DOCUMENTS 2,499,254 A * 2/1950 Parker ..... 206/545
3,122,225 A * 2/1964 Ward ..... 190/108
5,423,404 A * 6/1995 Shaw ..... 190/102
5,526,907 A 6/1996 Trawick et al.
5,660,476 A * 8/1997 DeCoster ..... 383/29
5,842,571 A 12/1998 Rausch
6,821,019 B2 11/2004 Mogil
7,334,684 B1 2/2008 Fontanilla et al.
8,043,004 B2 10/2011 Mogil
2008/0121630 A1* 5/2008 Simard ..... 219/387

* cited by examiner

*Primary Examiner* — Robert J Hicks
(74) *Attorney, Agent, or Firm* — Dale J. Ream

(57) ABSTRACT

A multi-use modular container includes a food storage container portion having insulated bottom and upstanding side walls defining a food storage container interior area and an open top. An insulated divider member is positioned in the food storage container interior area and divides the interior area into first and second chambers. The divider member is configured to maintain a different temperature in the first and second chambers. A non-food container portion includes non-insulated bottom and upstanding side panels that define an interior area and open top. The non-food container is releasably coupled to the food-container with a fastener. A storage compartment is situated on an outer surface of one of the upstanding side walls of the food storage container, the storage compartment defining a storage area and an opening configured to give selective access to the storage area.

5 Claims, 3 Drawing Sheets

MULTI-USE MODULAR CONTAINER

BACKGROUND OF THE INVENTION

This invention relates generally to both insulated and non-insulated containers and, more particularly to a multi-use container that enables a worker to carry his lunch, work items, and other personal items in a single container.

Workers, such as construction laborers, those who work in a warehouse, on the road salesmen, businessmen, truck drivers, bus drivers, and the like often desire a hot meal over a lunch break. Such workers often carry food items for lunch in a traditional lunch box, a soft-sided container but may not have access to a microwave oven. Workers may also have one or more work items that must also be taken to work or in the vehicle, such as a clipboard, notepad, or folders of paperwork. Still further, a worker often desires to carry personal items, such as a change of clothing, a music device, or just a book to read while eating. Unfortunately, carrying each of these items often requires multiple storage containers or many loose items in the vehicle or workplace. A single container large enough to carry each of these categories of items may not be appropriately configured to accommodate each type. In other words, a container that is insulated for food items may not accommodate non-food items and vice versa.

Various devices have been proposed in the art for storing and transporting food items, including insulated containers configured to maintain a heated or cooled environment. Other devices are known for transporting non-food items, such as backpacks, general carrying cases, and the like. Although assumably effective for their intended purposes, the existing devices do not provide an apparatus that includes an insulated container portion configured to store separately hot and cold food items, a non-insulated container portion configured to transport personal items, and a document storage compartment for transporting business/work documents.

Therefore, it would be desirable to have a multi-use modular container that fulfills the shortcomings of the prior art.

SUMMARY OF THE INVENTION

A multi-use modular container according to the present invention includes a food storage container portion having an insulated bottom and upstanding side walls defining a food storage container interior area and an open top. An insulated divider member is positioned in the food storage container interior area and divides the interior area into first and second chambers. The divider member is configured to maintain a different temperature in the first and second chambers. A non-food container portion includes non-insulated bottom and upstanding side panels that define an interior area and open top. The non-food container is releasably coupled to the food-container with a fastener. A storage compartment is situated on an outer surface of one of the upstanding side walls of the food storage container, the storage compartment defining a storage area and an opening configured to give selective access to the storage area.

Therefore, the multi-use modular container enables a user to store and transport food requiring an insulated container portion, non-food items not requiring an insulated container portion, and documents or a clipboard requiring a protected planar storage compartment.

A general object of this invention is to provide a multi-use modular container for a person to carry food, work supplies like a clipboard, and food items simultaneously and single handedly.

Still another object of this invention is to provide a multi-use modular container, as aforesaid, that separates food items, work or business items, and other personal items.

Yet another object of this invention is to provide a multi-use modular container, as aforesaid, having multiple internal food chambers such that hot and cold food and drink items may be kept separated and maintain desired temperatures.

A further object of this invention is to provide a multi-use modular container, as aforesaid, in which food and non-food container portions may be coupled and uncoupled from one another.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
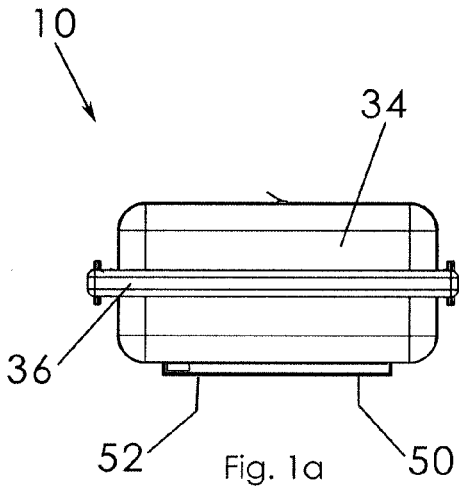
FIG. 1*a* is a top view of a multi-use modular container according to a preferred embodiment of the present invention.

A multi-use modular container according to a preferred embodiment of the present invention will now be described with reference to FIGS. 1*a* to 2 of the accompanying drawings. The multi-use modular container 10 includes a food storage container portion 20, a non-food storage container portion 40, and a top member 34.

The food storage container portion 20 includes a bottom 22 and a plurality of upstanding side walls 24 extending upwardly from the bottom 22. It is understood that the term "side walls" is used generically and may actually include front, rear, and side walls. Together, the bottom and side walls define an interior area. Upper edges of the bottom and side walls define an open top 26 (FIG. 2). It is understood that the bottom 22 and side walls 24 of the food storage container portion 20 have an insulated wall construction that are configured to maintain a temperature environment within the interior area. Specifically, the insulated walls enable a warm item placed within the interior area to stay warm or a cold item to stay cold. In addition, the exterior of the side walls 24 may include a soft fabric material for a comfortable appearance and use.

Figure 2:
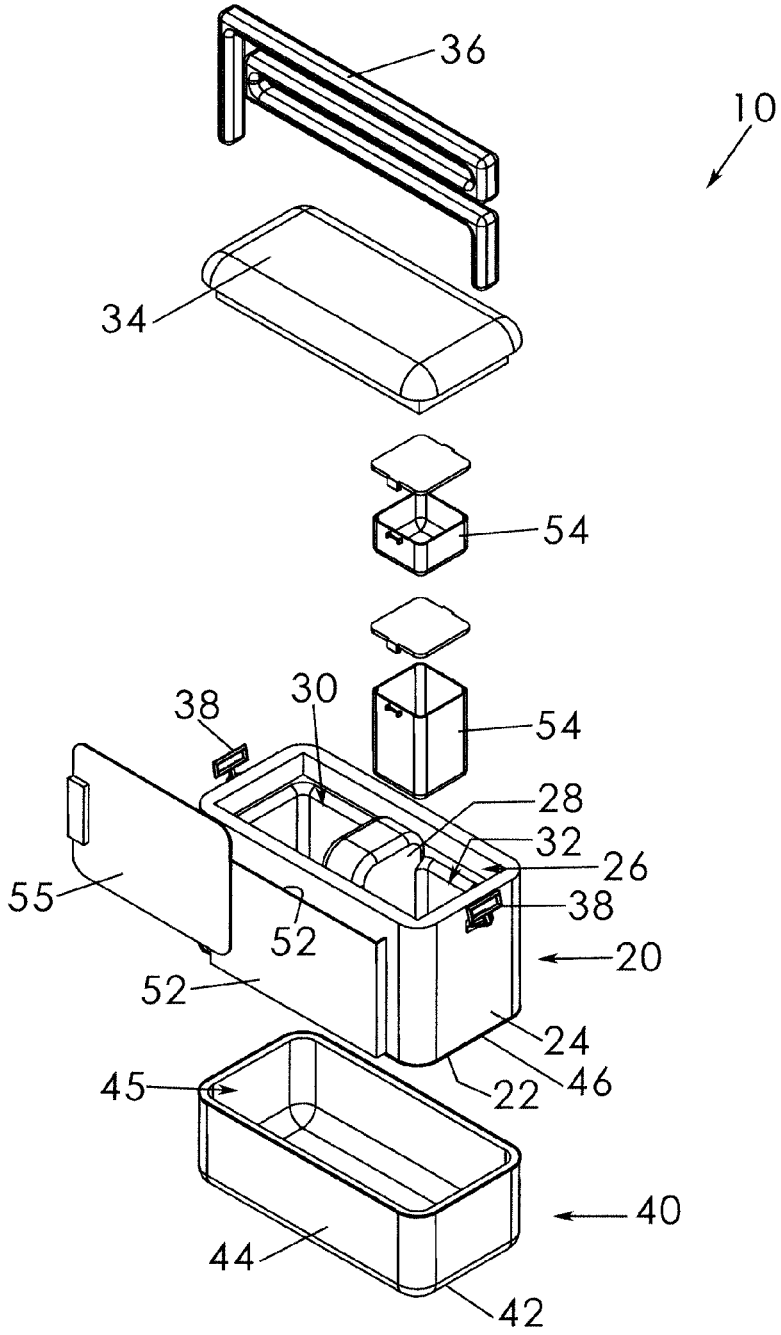
FIG. 2 is an exploded view of the container as in FIG. 1*b*.

A divider member 28 also having an insulated construction may be situated in the interior space of the food storage container portion 20 (FIG. 2). Preferably, the divider member 28 extends between the bottom 22 and the open top 26 and completely between a front and rear wall such that the interior area is completely divided by the divider member 28 into a first chamber 30 and a second chamber 32. The divider member 28 provides a common wall relative to the first 30 and second 32 chambers. Accordingly, each chamber is independently insulated on all sides and insulated from the other chamber. In other words, each chamber is configured to maintain a temperature environment different from the other chamber. In use, a cold beverage may be received into the first chamber 30 and a hot food item/container may be received into the second chamber 32. The insulated divider member 28 enables the cold and hot environments to be maintained without influencing one another.

The non-food storage container portion 40 may include a bottom wall 42 and upstanding side panels 44 extending upwardly therefrom. Together, the bottom wall 42 and side panels 44 define an interior space, the upper edges defining an open top 45. The bottom wall 42 and side panels 44 of the non-food storage container portion 40 are preferably not insulated. Specifically, there is no need to insulate the non-food storage container portion 40 in that it is not intended to hold food items, but rather to hold a person's personal items such as a wallet, keys, clock, books, electronic devices, or even a change of clothing.

Figure 1B:
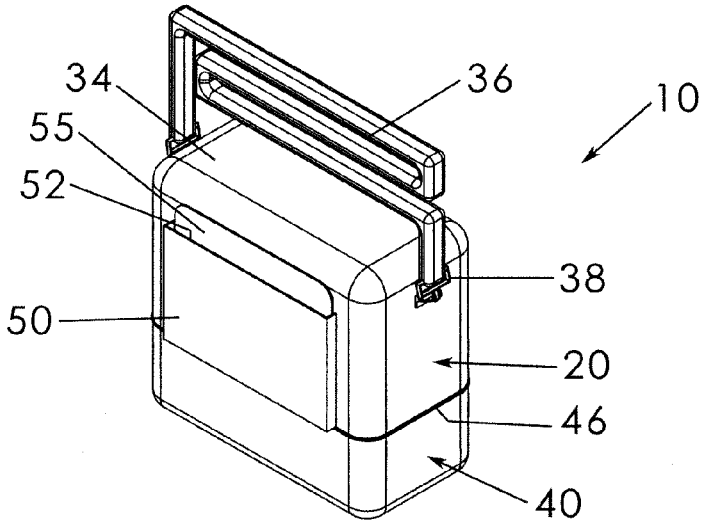
FIG. 1*b* is a perspective view of the container as in FIG. 1*a;*
Figure 1C:
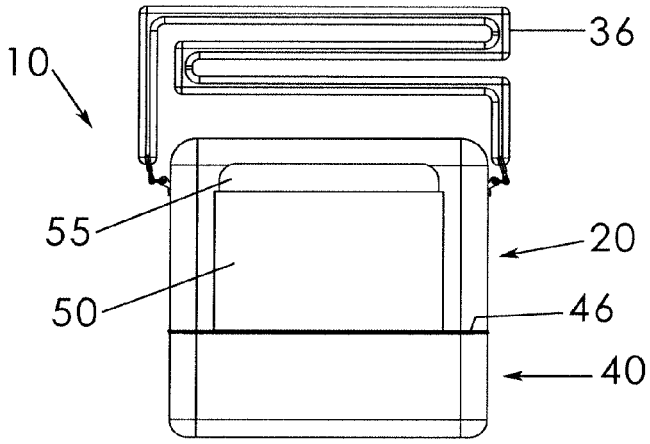
FIG. 1*c* is a front view of the container as in FIG. 1*b;*
Figure 1D:
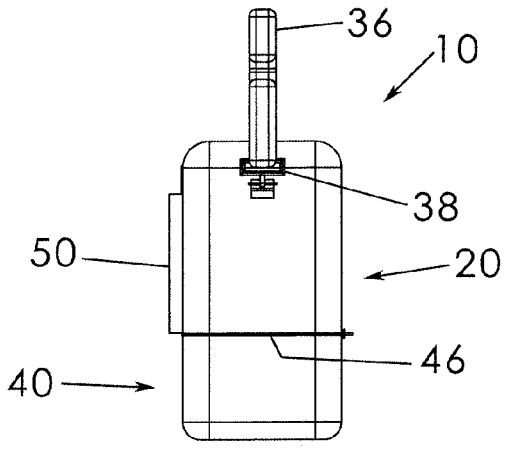
FIG. 1*d* is a side view of the container as in FIG. 1*b*.

The food storage container portion 20 may include a storage compartment 50 mounted to an outer surface of a respective side wall 24 (FIGS. 1*b* and 2). The storage compartment 50 defines an internal storage area and an opening 52 configured to selectively provide access to the storage area. The opening 52 may be upwardly oriented such that a user may conveniently insert a clipboard 55, notebook, folder or other planar item into the storage area without causing damage to the item, such as folding. In furtherance of this reason, the storage compartment 50 is preferably constructed of inflexible materials, such as plastic or metal, and includes a generally planar configuration specifically useful to secure and protect generally planar items such as a clipboard 55, folders, or papers.

The food storage container portion 20 may include a top member 34 configured to selectively cover the open top 26. The top member 34 includes a configuration and dimensions that are complementary to that of the upper edges of the side walls 24 of the food storage container portion 20. The top member 34 may be selectively coupled to the upper edges of the side walls 24 in a friction fit arrangement or with other traditional fasteners. Preferably, the top member 34 includes an insulated construction consistent with the insulated construction of the bottom 22 and side walls 24 as described above so as to further enable the interior area to maintain a consistent temperature environment. In addition, the top member 34 may be configured such that the bottom side thereof may be utilized as a tray or plate on which food items may be distributed and consumed from.

The non-food storage container portion 40 and the food storage container portion 20 are configured to be selectively coupled together. More particularly, the bottom 22 of the food storage container portion 20 and the upper edges of the side panels 44 of the non-food storage container portion 40 have complementary configurations such that the food storage container portion 20 may be positioned atop the non-food storage container portion 40 and secured thereto with a fastener 46. In a preferred embodiment, the fastener 46 may be a zipper such that the container portions may be quickly coupled or uncoupled relative to one another. Preferably, the food storage container portion 20 is not nested within the interior area of the non-food storage container portion 40 as this would not enable any room for non-food items to be transported or stored simultaneously with food items as is an object of the invention.

The top member 34 of the food storage container portion 20 may include a handle 36 such that food storage container portion 20 may be lifted and carried by a user. The handle 36 may be a flexible strap. Further, the food storage container portion 20 and the non-food storage container portion 40 may be lifted together by the handle 36 when they are coupled together as described above. Further, the food storage container portion 20 may include a pair of auxiliary handles 38 mounted to outer surfaces of respective side walls 24 such that the food storage container portion 20 may be lifted as with a traditional cooler. In some embodiments, the handle 36 may be coupled to the auxiliary handles 38, as shown in FIG. 1*b*.

The multi-use modular container 10 may also include at least one auxiliary food container(s) 54 (FIG. 2). Preferably, a plurality of auxiliary food containers is included, each having a different size and shape configuration suitable to store a different type of food item, for example, meat, main course, side item, or the like.

In use, the multi-use modular container 10 may be loaded with food, non-food, and work related items to be transported or stored simultaneously. More particularly, the non-food storage container portion 40 may be separated from the food storage container portion 20 as described above (e.g. by unfastening the zipper fastener) and personal items loaded into the interior area thereof. For instance, a user may choose to take non-food items in the non-food storage container portion 40—items not needing an insulated storage area—such as a book, an mp3 music player, or other items for use during a lunch break. Then, the user may load items needing insulated storage into the food storage container portion 20, such as a cold beverage container or heated food item in an auxiliary food container 54. Finally, the user may load the storage compartment 50 with planar items, such as a clipboard, folders, or other generally planar items. The food storage container portion 20 and the non-food storage container portion 40 may then be coupled together with the fastener 46 as described above and the entire container may carried by its handle 36 or auxiliary handles 38.

It is understood that while certain forms of this invention have been illustrated and described, it is not limited thereto except insofar as such limitations are included in the following claims and allowable functional equivalents thereof.

What is claimed is:

1. A multi-use modular container, comprising:

a food storage container portion having a bottom and a plurality of upstanding side walls extending upwardly from the bottom defining a food storage container interior area and an open top, said upstanding side walls and said bottom having an insulated wall construction;

an insulated divider member positioned in said food storage container interior area, said divider member extending between said bottom and said open top and dividing said food storage container interior area into a first chamber and a second chamber, said divider member being a common wall to said first and said second chambers and is configured to maintain a different temperature in said first and second chambers;

wherein said first and said second chambers are independently insulated on all sides such that a temperature in a respective first and second chamber does not influence a temperature in another respective first and second chamber;

a non-food storage container portion having a bottom wall and upstanding side panels extending upwardly therefrom defining a non-food storage container portion interior area and an open top, said bottom wall and upstanding side panels having a non-insulated construction;

wherein said side panels of said non-food storage container portion include upper edges removably coupled to said bottom of said food storage container with a zipper; and a storage compartment situated on an outer surface of one of said upstanding side walls of said food storage container, said storage compartment defining a storage area and an opening configured to give selective access to said storage area;

wherein said opening is situated along an upward edge of said storage compartment configured to receive a clipboard into said storage area from an upward angle.

2. The multi-use modular container as in claim 1, wherein said food storage container portion includes a top member configured to selectively cover said open top of said food storage container portion, said top member having an insulated construction.

3. The multi-use modular container as in claim 2, wherein said top member of said food storage container portion includes a handle by which said food storage container portion and said non-food storage container portion are lifted simultaneously when said food storage container portion and said non-food storage container portion are coupled together and a user lifts said handle.

4. The multi-use modular container as in claim 1, further comprising at least one auxiliary food container removably situated in at least one of said first and second chambers of said food storage container interior area.

5. The multi-use modular container as in claim 3, wherein said food storage container portion includes a pair of auxiliary handles mounted to outer surfaces of respective upstanding side walls.

* * * * *